US005169495A

United States Patent [19]

Lachenal

[11] Patent Number: 5,169,495

[45] Date of Patent: Dec. 8, 1992

[54] PROCESS FOR BLEACHING HIGH YIELD PULP WITH HYDROGEN PEROXIDE BY ADJUSTING THE ALKALINITY DURING BLEACHING WITH SODIUM HYDROXIDE

[75] Inventor: Dominique Lachenal, Grenoble Cedex, France

[73] Assignee: Atochem, Puteaux, France

[21] Appl. No.: 693,629

[22] Filed: Apr. 30, 1991

[30] Foreign Application Priority Data

Apr. 30, 1990 [FR] France ..... 90 05748

[51] Int. Cl.[5] ..... D21C 9/16

[52] U.S. Cl. ..... 162/78; 162/90

[58] Field of Search ..... 162/78, 90, 19, 80, 162/76

[56] References Cited

FOREIGN PATENT DOCUMENTS

| | | | |
|---|---|---|---|
| 2601380 | 7/1976 | Fed. Rep. of Germany | 162/78 |
| 3333219 | 3/1984 | Fed. Rep. of Germany | 162/78 |
| 57-25492 | 2/1982 | Japan | 162/78 |

OTHER PUBLICATIONS

Colodette et al., "The Effect of pH Control on Peroxide Brightening of Stonegroundwood Pulp", J. of Pulp and Paper Science: vol. 16, No. 2, Mar. 1990.

Yotsuya et al., *Abstract Bulletin of the Institute of Paper Chemistry,* vol. 53, No. 4, issued Oct. 1982, Abstract No. 4579.

Abou-State et al., *Abstract Bulletin of the Institute of Paper Chemistry,* vol. 55, No. 8, issued Feb. 1985, Abstract No. 8870.

*Primary Examiner*—Steve Alvo

*Attorney, Agent, or Firm*—Burns, Doane, Swecker & Mathis

[57] ABSTRACT

High-yield lignocellulosic wood pulps are bleached by treating same with an effective bleaching amount of hydrogen peroxide in an alkaline treatment medium, including adjusting the alkalinity of such pulp by adding a supplementary amount of alkaline agent thereto at that point in time when the amount of hydrogen peroxide consumed ranges from 40% to 75% of the effective amount thereof.

7 Claims, No Drawings

PROCESS FOR BLEACHING HIGH YIELD PULP WITH HYDROGEN PEROXIDE BY ADJUSTING THE ALKALINITY DURING BLEACHING WITH SODIUM HYDROXIDE

CROSS-REFERENCE TO COMPANION APPLICATION

Copending application Ser. No. 07/693,800, filed concurrently herewith and assigned to the assignee hereof.

BACKGROUND OF THE INVENTION

1.Field of the Invention

The present invention relates to the bleaching of high-yield wood pulp with hydrogen peroxide in an alkaline medium.

By the term "high-yield wood pulp" ar intended the wood and paper pulps produced in a high yield by weight in the dry state relative to the starting lignocellulosic material, typically in the form of chips, constituting the dry state, namely, a yield greater than about 85% and often at least 90% by weight.

2. Description of the Prior Art

The aforedescribed wood pulps are characteristically produced by grinding the above starting material, typically wood chips, by means of a mill or a disc grinder, whether or not accompanied by a chemical and/or heat treatment.

Exemplary are those referred to in this art as mechanical, thermomechanical and chemithermomechanical pulps.

The bleaching of such pulps entails chemically decolorizing the chromophores of the wood constituents without solubilizing same. The chromophoric group responsible for the dark color of the pulp are principally borne by lignin and certain extracts (tannins).

Two types of processes are currently employed to carry out this decolorization:

(a) a first technique which entails reacting the pulp with a reducing agent, traditionally hydrosulfite, under mild conditions and in a neutral or slightly acidic medium. The reduction of the chemical groups responsible for the objectionable color results in a partial bleaching which is nonetheless sufficient for certain applications;

(b) a second technique which entails oxidizing the chromophores with hydrogen peroxide in an alkaline medium; the bleaching attained thereby is greater than in the first process, which explains why the peroxide process is presently increasingly employed to satisfy various paper quality requirements.

However, hydrogen peroxide is costly and its stability decreases as the pH increases. While it is accepted in this art that the pH range in which the bleaching with hydrogen peroxide is normally carried out extends from approximately 9 to approximately 11, as reported in "The Bleaching of Pulp", TAPPI Press, Singh ed., p. 227, Atlanta (1970), continuing need exists in the industry for further improvements in the area of such hydrogen peroxide processing.

Nonetheless, any such improvement must avoid the darkening of the pulp which is known to result from the presence of an alkaline agent, e.g., sodium hydroxide, NaOH ("alkaline" darkening), and the bleached pulp must be protected by acidification as described at page 229 of the TAPPI article indicated above.

It has thus been proposed to this art to use the hydrogen peroxide in at least two separate bleaching stages.

For example, in published application WO-84/02,366 a first stage is described in which the alkalinity conditions are abnormally high with a view to improving the mechanical quality of the fibers, and a second stage under conditions of normal alkalinity to compensate for the bleaching deficiency resulting from the first stage.

In TAPPI Journal, March 1987, pages 119 et seq., D. Lachenal also describes a two-stage process, but in which an amount of sodium hydroxide is used in the second stage which is much greater than that normally employed for a first stage.

Finally, French Patent No. 2,537,177 recommends maintaining conditions which are as uniform as possible throughout the bleaching operation while utilizing a succession of separate stages.

In each of the above processes, one stage differs from the following one in that the materials which have been used in the first, in particular hydrogen peroxide and alkaline agents such as sodium hydroxide, are intermediately removed from the pulp, at least for the most part, for example 90%, normally by washing and/or pressing the pulp. The resulting energy and capital costs militate against improving the efficiency of usage of the hydrogen peroxide.

SUMMARY OF THE INVENTION

Accordingly, a major object of the present invention is the provision of an improved process for the $H_2O_2$ bleaching of wood pulp in an alkaline medium, which improved process does not require any intermediate or in-line removal of the $H_2O_2$ or alkaline agents during the overall bleaching operation.

Briefly, the present invention features the bleaching of high-yield pulps by mean of hydrogen peroxide in an alkaline medium, comprising adjusting the alkalinity of the pulp by adding an alkaline agent thereto at that point in the bleaching operation when the amount of hydrogen peroxide consumed ranges from 40% to 75% of the initial amount thereof.

DETAILED DESCRIPTION OF THE PREFERRED EMBODIMENTS OF THE INVENTION

More particularly according to the present invention, by the term "pulp" is intended the combination of the lignocellulosic material in the dry state together with the liquid content thereof.

And in the following description and actual working examples, all parts and percentages are given by weight relative to the weight of the pulp in the dry state, unless otherwise indicated.

According to the present invention, it has been found that it is frequently advantageous to carry out the introduction of the additional amount of alkaline agent when approximately 50% to 60% of the initial hydrogen peroxide has been consumed.

The alkaline agent added to the pulp during bleaching is typically sodium hydroxide, in an amount which generally ranges from 0.5% to 4%, and preferably from 1% to 2%.

An alkaline agent other than sodium hydroxide may be added, provided that it ensures adjusting the alkalinity of the pulp to the same extent as would the sodium hydroxide which it replaces.

The amount of hydrogen peroxide $H_2O_2$ which is employed, added in its entirety to the pulp at the beginning of the bleaching operation, may range from 1% to 6%, preferably from 2% to 4%. The total amount of sodium hydroxide used, as a sum of the amounts added at the beginning of and during bleaching according to the process of the invention, advantageously ranges from 1% to 5%. As in the processes of the prior art, the bleaching may be carried out in the presence of sodium silicate, for example from 2% to 6% and typically from 3% to 5% of an aqueous solution of sodium silicate at a concentration of 40.Be, namely, having a relative density of 1.38, referred to simply as sodium silicate. It may also be carried out in the presence of metal ion complexing agents, such as 0.1% to 0.5% of an aqueous solution, referred to as DTPA, containing 40% by weight of the sodium salt o diethylenetriaminepentaacetic acid. The bleaching may be carried out at a consistency ranging, for example, from 5% to 40%, typically from 10% to 20%, at a temperature ranging from 40° C. to 90° C., typically from 50° C. to 80° C. The p of the pulp during the bleaching thus remains from 8.5 to 11.5, namely, within the usual limits.

The total bleaching time depends on the particular selection of the various process parameters. It may be, for example, on the order of 4 to 6 hours when it is ascertained that the brightness of the pulp exhibits essentially no further change over time, as is the case in the examples given below.

The length of the period of time between initiation of the bleaching and the time at which the additional amount of alkaline agent is added depends essentially on the amount of peroxide introduced and on the temperature selected. The preferred conditions correspond to a value of such time period which does not exceed that separating the time at which the alkalinity of the pulp is deliberately adjusted and completion of the bleaching.

In order to further illustrate the present invention and the advantages thereof, the following specific examples are given, it being understood that same are intended only as illustrative and in nowise limitative.

EXAMPLES 1 to 6

An epicea fir grindstone pulp having a brightness of 59°ISO was bleached with hydrogen peroxide under the following conditions:

$H_2O_2$: 4%, NaOH: 2.5%, sodium silicate: 3%, DTPA: 0.25%, consistency: 15%, temperature: 60° C., until x% of hydrogen peroxide had been consumed, the value of x being different from one example to another, and then 1.5% of sodium hydroxide was added to the pulp and the bleaching was then continued to completion over a total period of time of 6 hours.

The results are reported in Table I below:

TABLE I

| Example No. | x, % | Bleached pulp, brightness, °ISO |
|---|---|---|
| 1* (comparative) | 0 | 80.5 |
| 2 (comparative) | 37 | 80.7 |
| 3 | 49 | 81.3 |
| 4 | 56 | 81.6 |
| 5 | 61 | 82.2 |
| 6 | 63 | 81.9 |

*pulp bleached for 6 hours under the initial conditions indicated and without additional introduction of 1.5% of sodim hydroxide during bleaching.

EXAMPLE 7 (Comparative)

This example employed the same pulp as in Examples 1 to 6 and the procedure was as in Example 1, without introduction of NaOH during bleaching, but using 4% of NaOH instead of 2.5% and, therefore, using an amount of NaOH which was equal to the sum of the amounts of NaOH which were added to the pulp at the beginning of and during bleaching in Examples 3 to 6 which are in accordance with the invention.

At the end of the 6 hours of bleaching, the pulp had a brightness of 80.7°ISO, namely, similar to that attained in Examples 1 and 2 and therefore still markedly lower than that provided by the invention.

EXAMPLE 8 (Comparatively)

The same pulp as in the preceding examples was bleached under the initial conditions of Example 1 until 50% of the hydrogen peroxide had been consumed.

The pulp was then pressed and restored to a consistency of 15% by adding water and 1.5% of NaOH and was bleached up to a total bleaching time of 6 hours using the residual hydrogen peroxide, i.e., 1.4%.

The bleached pulp had a brightness of 81°ISO, which did not present any advantages vis-a-vis the present invention, but a certain economic disadvantage when compared therewith.

EXAMPLE 9 (Comparative)

The same pulp as in the preceding examples was bleached as in Example 1, but using 2% of $H_2O_2$ instead of 4% and until 80% of the hydrogen peroxide had been consumed. 1.5% of NaOH was then added to the pulp and the bleaching was continued until completion thereof, reached after a total period of time of 6 hours.

The pulp then had a brightness of 72.2°ISO and "alkaline" darkening was observed.

A decrease in the amount of supplementary NaOH did not alter these results. For example, by operating with 0.5% of additional NaOH instead of 1.5%, the brightness of the bleached pulp was only 76°ISO, a value which was lower than that of 76.8°ISO attained after 6 hours without additional NaOH.

EXAMPLES 10 to 13

A chemithermomechanical pulp, or CTMP pulp, of epicea fir having a brightness of 61.2°ISO was bleached under the following conditions:

$H_2O_2$: 4%, NaOH: 2.5%, sodium silicate: 3%,

DTPA: 0.25%, consistency: 15%, temperature: 60° C., until 52.5% of the hydrogen peroxide had been consumed.

An amount of NaOH equal to 7% was then added to the pulp, the value of y being different from one example to another, and bleaching was continued to completion, reached after a total time of 6 hours.

The results are reported in Table II below:

TABLE II

| Example No. | y, % | Bleached pulp, brightness, °ISO |
|---|---|---|
| 10 (comparative) | 0 | 80.9 |
| 11 | 1 | 81.2 |
| 12 | 1.5 | 81.7 |
| 13 | 2.5 | 79.0 |

In Example 13, an already accentuated "alkaline" darkening of the pulp was observed.

The examples provided, combined with the indication of the ranges of variation of the various parameters, in particular those of the total and additional amounts of alkaline agent, an assessment of the advantages of the invention.

It will also be appreciated that the change in alkalinity provided by the addition of the alkaline agent during the bleaching according to the invention was in most cases indicated by an increase in the pH of the pulp by at least one pH unit.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the bleaching of a high-yield lignocellulosic pulp, comprising bleaching said pulp with an initial effective amount of hydrogen peroxide in an alkaline treatment medium containing and including adjusting the alkalinity of such pulp by adding a supplementary amount of sodium hydroxide ranging from 1% 2% by weight thereto at that point in time when the amount of hydrogen peroxide consumed ranges from about 49% to 63% by weight of the initial amount thereof and wherein the hydrogen peroxide is not removed during the bleaching.

2. The process as defined by claim 1, said alkaline treatment medium comprising a total amount of sodium hydroxide ranging from 1% to 5% by weight relative to the dry weight of said pulp.

3. The process as defined by claim 1, said effective bleaching amount of hydrogen peroxide ranging from 1% to 6% by weight of the dry weight of said pulp.

4. The process as defined by claim 1, carried out in the presence of a minor amount of sodium silicate.

5. The process as defined by claim 1, carried out in the presence of a metal ion complexing agent.

6. The process as defined by claim 1, carried out at a pH ranging from about 8.5 to 11.5.

7. The process as defined by claim 1, carried out at a consistency ranging from 5% to 40%.

* * * * *